US006463948B2

(12) United States Patent
Lee

(10) Patent No.: US 6,463,948 B2
(45) Date of Patent: Oct. 15, 2002

(54) TENT WITH EXTERIOR SCREEN HOUSE

(76) Inventor: Youn Jae Lee, 1515 Honeysuckle Ct., Pleasanton, CA (US) 94588

( * ) Notice: Subject to any disclaimer, the term of this patent is extended or adjusted under 35 U.S.C. 154(b) by 0 days.

(21) Appl. No.: 09/909,626

(22) Filed: Jul. 19, 2001

(65) Prior Publication Data

US 2002/0000241 A1 Jan. 3, 2002

Related U.S. Application Data

(62) Division of application No. 09/356,109, filed on Jul. 16, 1999, now abandoned

(60) Provisional application No. 60/093,092, filed on Jul. 16, 1998.

(51) Int. Cl.[7] ..... E04H 15/42

(52) U.S. Cl. ..... 135/156; 135/97; 135/136

(58) Field of Search ..... 135/124, 128, 135/141, 156, 97, 115, 120.1, 126, 132, 133, 136

(56) References Cited

U.S. PATENT DOCUMENTS

| | | | | |
|---|---|---|---|---|
| 1,775,145 | A | * | 9/1930 | Tennant et al. |
| 3,670,747 | A | * | 6/1972 | Pohl et al. |
| 4,285,355 | A | * | 8/1981 | Lundeblade |
| 4,541,445 | A | * | 9/1985 | Ferguson |
| 4,709,718 | A | * | 12/1987 | Nichols |
| 4,827,958 | A | * | 5/1989 | Cantwell et al. |
| 5,107,881 | A | * | 4/1992 | Feldman et al. |
| 5,638,850 | A | * | 6/1997 | Hazinski et al. |
| 5,901,726 | A | * | 5/1999 | Gal et al. |

* cited by examiner

*Primary Examiner*—Blair M. Johnson
(74) *Attorney, Agent, or Firm*—Larry B. Guernsey; Intellectual Property Law Offices

(57) ABSTRACT

A tent with an exterior screen structure (200) having an inner tent structure (310), including an inner fabric enclosure (311) which serve as walls (328, 330, 332), roof (334) and floor (336) of the inner tent structure (310) and an outer tent structure (210) including an outer fabric enclosure (211). A single frame (212) supports both inner (311) and outer fabric enclosures (211).

13 Claims, 7 Drawing Sheets

TENT WITH EXTERIOR SCREEN HOUSE

This application is a divisional of prior application Ser. No. 09/356,109 abandoned, which was filed on Jul. 16, 1999. This application also claims priority from U.S. Provisional Applications Serial No. 60/093,092 filed Jul. 16 1998, which has the same inventor as the present application.

TECHNICAL FIELD

The present invention relates generally to cabin tent structures, and more particularly to tent pole and hub systems as well as fabric-covered structures

BACKGROUND ART

One of the earliest forms of shelter known to humankind is the tent. Huge variety in tent design exists, but common elements include tent fabric and tent poles which shape and support the fabric. Most tents use multiple tent poles, often with hubs connecting the tent poles together. It therefore becomes the combination of poles and hubs which define many characteristics of such tents. Examples of important characteristics include structural shape, rigidity, ability to support the tent fabric, and reaction to externally applied stresses such as those caused by bumping into the tent or from wind buffeting the tent and causing the walls to vibrate.

For purposes of the following discussion, tent poles will be classed as side poles, gable poles, ridge poles, and horizontal poles. In assembled tents, side poles extend in a generally vertical orientation from the ground surface up to the beginning of the roof region of a tent. Gable poles extend from the edge of a tent roof upward to the peak of the tent roof, and have a sloping orientation (i.e., generally in the range of 30 to 60 degrees relative to horizontal). Ridge poles are generally horizontal, but for discussion here are strictly defined as being at the peak of the tent roof (the term tie pole is sometimes used for this). Finally, horizontal poles are herein strictly defined as including all generally horizontally oriented poles except ridge poles (e.g., they include poles typically used at the eaves or lower roof edges of some tent designs).

Balancing tent pole system characteristics is not an easy engineering task. Some of the already mentioned characteristics urge contradictory engineering solutions. For example, strong rigid shapes generally are best accomplished by framing the shape in closed geometric shapes, such as the triangular and rectangular members used in engineering wire-frame drawings. Unfortunately, while framed sections are strong and rigid, they also transmit force and vibration very well, often with undesirable results. Further, framed sections may require more parts than other designs, and therefore may result in increased overall tent weight and cost. Thus, optimizing only some characteristics may conflict with general goals for an entire tent system.

For discussion here, tent pole systems can be defined as free standing, pre-stressed, and gravity assisted systems. In the market today, the free standing system is used primarily for larger tents (including yurts, and show tents); the pre-stressed construction is used primarily in smaller, shorter type (one and two person) portable tents; and gravity assisted systems are primarily used for cabin tents (i.e., tents large enough to accommodate at least a small family, and usually tall enough that an average adult can stand fully upright in the tent center). A good example of a free standing tent system is the teepee. It has a very strong and rigid frame over which fabric is draped. However, the fabric adds nothing to the strength or shape of the finished tepee. When designing tepees the tent fabric and the tent pole system are effectively two unrelated problems. At an opposite extreme are pre-stressed pole systems, good examples of these can be found today in tents using fiberglass poles which are bent into place during assembly and held together by the tent fabric in a spring-like manner to define the tent structure. Attempting to assemble such a tent with only the poles and hubs (if any) would be impossible, or at best produce a very flimsy structure. Finally, in a category falling between the free standing and pre-stressed systems are gravity-assisted systems. Many cabin tents in the market today belong in this classification. In such tents the poles do not form as strong a system as when no tent fabric is assembled onto them, nor are the tent poles intentionally bent in the manner of springs to assemble and tension the tent. Rather, once assembled onto a finished tent, the fabric under the weight of gravity helps to define and stabilize the final tent structure. In such tents the critical components become the hubs used to connect the tent poles, since it is in these that forces concentrate and must be accommodated.

Various forces are applied to tent hubs, either directly, or more commonly indirectly, through the tent poles inserted into the hubs. One such force is fabric weight, which actually may be variable, since rain, snow, and other substances can "weigh down" tent fabric. External stresses form another group of forces which also ultimately reach the hubs. Assembled tents may be bumped by users who are either inside or outside of the tent. And when present, wind may range from constantly pressing against the tent from one direction to buffeting it from rapidly changing directions at different speeds, thereby causing vibration in the tent structure. It therefore follows that for a cabin tent design to be acceptable the hubs which are used must successfully deal with all of these forces.

Additional concerns for many tent designs are parts count and overall tent weight. Reducing parts count has the obvious advantage that fewer parts mean less loss or misplacement and almost always reduces cost also, particularly if the eliminated parts are tent poles made of aluminum. And, usually, reducing parts count leads to a more intuitive assembly process, and sometimes a simpler one as well. Further, it may strongly affect tent weight. Generally, of the three major components used in cabin tents the fabric is least dense, the hub has intermediate density (at least in plastic hubs, as are preferred today), and the poles are most dense, since they are metal or high density plastic like fiberglass. There are, of course, also notable size differences in these components. For example, hubs and poles are markedly different in size. Thus, by accepting some size increase in smaller less dense parts, to eliminate some high density large parts entirely, an overall weight savings may be accomplished by selective parts count reduction.

From the above discussion it should be clear that good tent design must balance many factors.

DISCLOSURE OF INVENTION

Accordingly, it is an object of the present invention to provide a tent which can be assembled in very little time, and with a minimum of separate pieces.

Another object of the invention is to provide a tent which has a convertible roof.

And, another object of the invention is to provide a tent which has an exterior screen structure.

Briefly, one preferred embodiment of the present invention is an improved tent for quick construction, including a fabric enclosure which serves as walls, roof and floor of the tent. The tent also includes a frame which attaches to and supports the fabric enclosure. The frame includes at least two frame poles having upper and lower ends. The frame poles form at least one V-shape, the lower ends being positioned in close proximity to form the tip of the V-shape, and the upper ends spread apart forming the legs of the V shape. The upper ends tend to fall away from each other on either side of a bisecting vertical line to the extent allowed by their attachment to the fabric enclosure, thereby spreading the fabric enclosure and aiding in the quick construction of the tent.

A second preferred embodiment of the present invention is a convertible tent which includes a fabric enclosure which serves as walls, roof and floor of the tent. A frame supports the fabric enclosure and configures the fabric enclosure into a tent. The tent roof includes a top portion and a screen portion, the top portion being convertible so that the screen portion is exposed.

A third preferred embodiment of the present invention is a tent with an exterior screen structure having an inner tent structure, including an inner fabric enclosure which serve as walls, roof and floor of the inner tent structure and an outer tent structure including an outer fabric enclosure. A single frame supports both inner and outer fabric enclosures.

An advantage of the present invention is that the first preferred embodiment contains a V-shaped side support structure which minimizes the number of pieces required for assembly of the tent.

Another advantage of the invention is that a second preferred embodiment contains a screened roof portion which can be exposed to present a convertible roof.

And, another advantage of the invention is that a third preferred embodiment includes a inner structure which is enclosed by an outer screen structure. The space between the inner and outer structures provides a protected living area for users.

These and other objects and advantages of the present invention will become clear to those skilled in the art in view of the description of the best presently known mode of carrying out the invention and the industrial applicability of the preferred embodiment as described herein and as illustrated in the several figures of the drawings.

The purposes and advantages of the present invention will be apparent from the following detailed description in conjunction with the appended drawings in which.

BEST MODE FOR CARRYING OUT THE INVENTION

Three preferred embodiments of improved camping tents are described, 1) the Quick Pitch Tent, 2) the Open Roof Convertible Tent, and 3) the Tent with Exterior Screen house. Each shall be described in turn.

The Quick Pitch Tent

Figure 1:
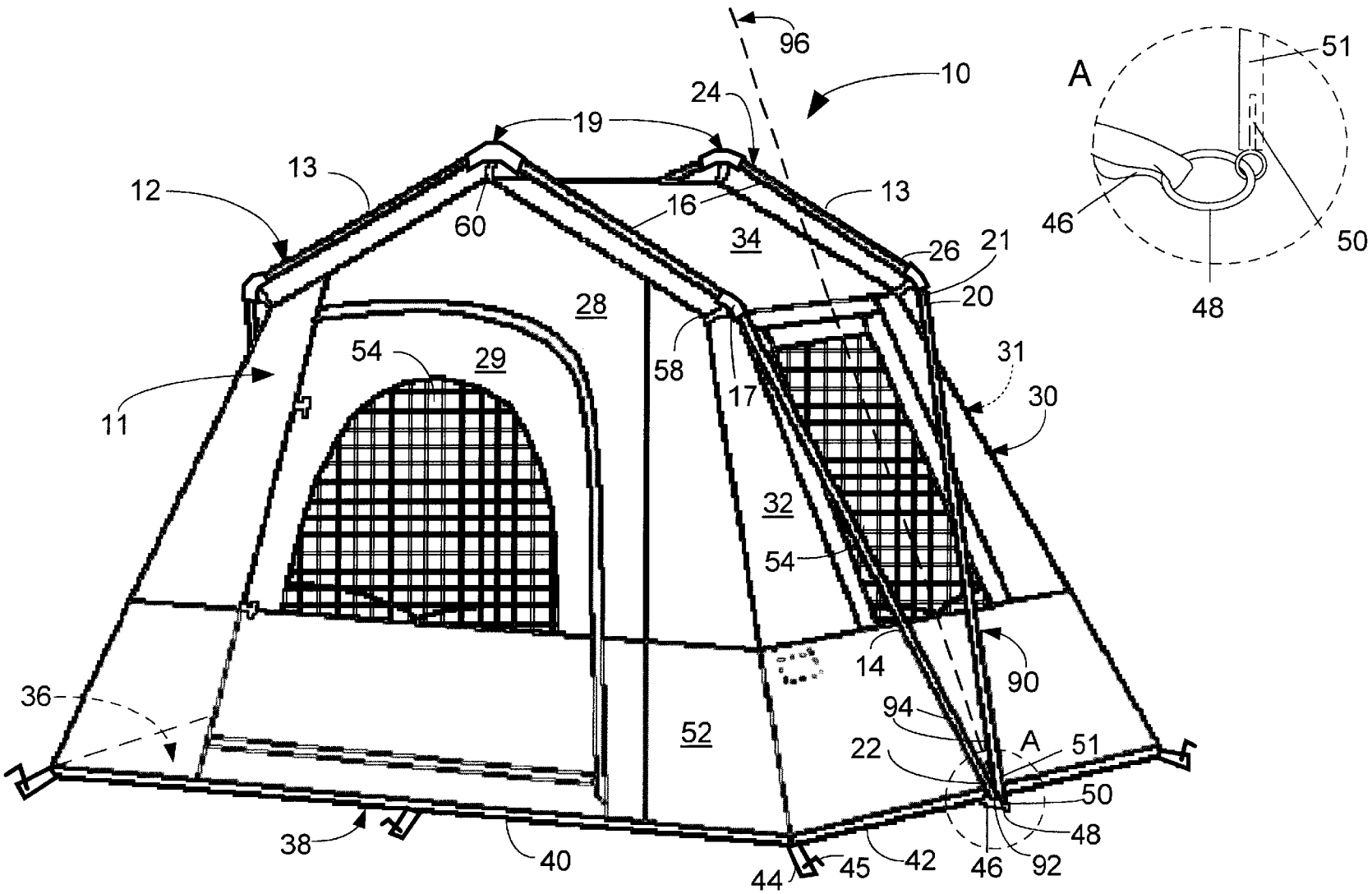
FIG. 1 shows a perspective view of the "Quick Pitch Tent" embodiment of the present invention, including a detail view A of the attachment site of a frame pole to a pin ring.

A preferred embodiment of the present invention is an improved camping tent. As illustrated in FIG. 1, a form of this preferred embodiment of the inventive device is a pole and fabric system of a tent depicted by the general reference character 10. The tent 10 includes generally a fabric enclosure 11 and a frame 12.

The frame 12, in this case, includes four frame poles 13. Each frame pole 13 includes a side pole portion 14, and a gable pole portion 16. Connections between side pole portion 14 and gable pole portion 16 are accomplished by means a curved elbow portion 17. Two peak hubs 19 are used to connect the gable pole portions 16 of the frame poles 13. Each side pole portion 14 has an upper end 20 and a lower end 22. Each gable pole portion 16 has an upper end 24 and a lower end 26.

The fabric enclosure 11 has a front wall 28 with a front door 29, a rear wall 30 with a rear window 31, two side walls 32, two roof panels 34 and a floor 36 (not visible). At the juncture of the walls 28, 30, and 32, with the floor 36, there is a perimeter 38 with front and back side portions 40 and two side portions 42. At the four corners of the perimeter 38 there are corner loops 44 through which stakes 45 can be driven to secure the tent 12 to the ground. At approximately the center of each perimeter side portion 42 there are side loops 46 to each of which are attached a pin ring 48 to which are secured two pins 50, which are sized to mate with sockets 51 on the lower ends 22 of the side poles 14. The tent also optionally has a skirt 52 and screened windows 54 which can be covered by flaps 56 (not visible) when required. The flaps 56 can be secured to block the windows by peripheral zippers, ties, velcro™ fasteners or any number of other conventional means.

At the juncture of front or back walls 28, 30, side wall 32 and roof panels 34, there are retaining loops 58 with plastic hooks which serve to attach the tent fabric to the frame near the curved elbow portion 17. At the juncture of front or back walls 28, 30, and roof panels 34, there are peak retaining loops 60.

The frame poles 13 are made up of a number of component pieces such as the side pole portions 14, the gable pole portions 16 and the curved elbow portions 17 which are connected together end to end to make the final composite length, but which can be detached for compact storage and transportation. The side pole portions 14 and the gable pole portions 16 can themselves be composed of smaller component pieces. The frame poles 13 are preferably composed of hollow tubing, which encloses an elastic connecting material which acts to urge the component pieces into retained engagement with each other, when the pole has been constructed. When disassembled, the component pieces are then still connected together by the elastic connector (not visible), which helps to keep the pieces grouped.

The connectors also make it nearly impossible to assemble the pieces incorrectly, or to mate incompatible ends, and assembly of the tent structure is made much quicker, since pieces need not be sorted and matched to their mating parts. The connectors may also not be elastic along their complete length. The portion exposed at the joins of the pieces may be of chain links or cable while the portion that remains encased within the hollow pole portion may be of elastic. Thus, the more fragile elastic material is protected from cuts or abrasions.

The lower end 22 of the side pole portion 14 of frame pole 13 has a socket 51, which is sized to receive one of the pins 50 on the pin ring 48. Detail circle A shows these elements in greater detail. For clarity, only one pin 50 is shown attached to the pin ring 48, although in this embodiment, there are actually two, one for the socket 51 of each frame pole 13.

Figure 2:
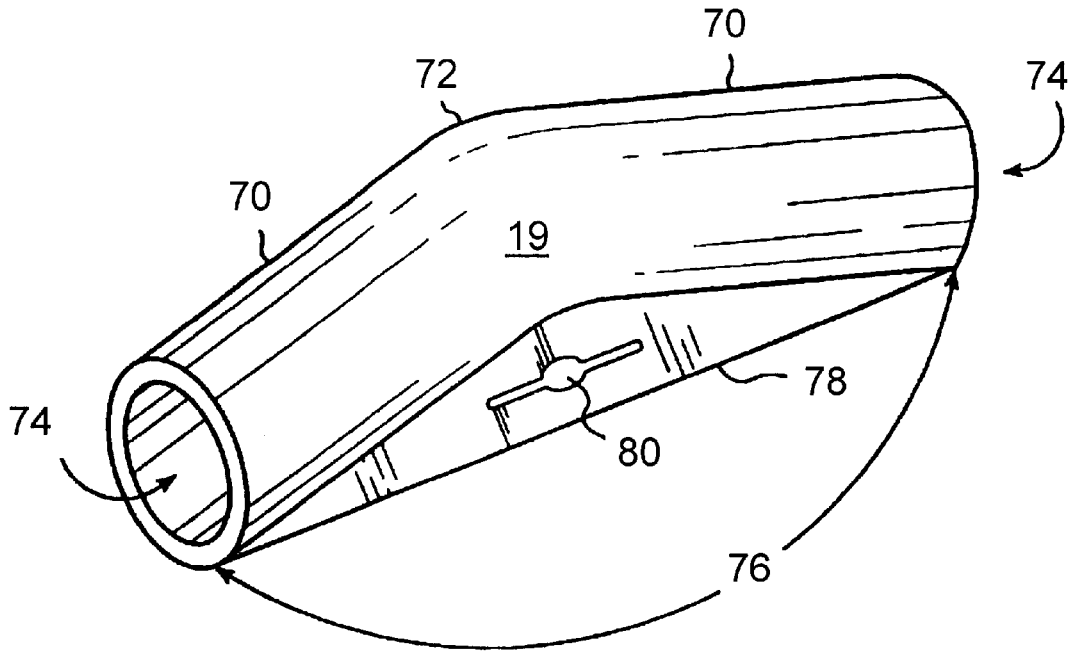
FIG. 2 illustrates a perspective view of a peak hub of the present invention.

As seen in more detail in FIG. 2, the peak hubs 19 have two tubular members 70 connected at a junction 72. Ports 74 are open at either end of the hub 19, and are sized to accept the upper end 24 of a gable pole portion 16 of frame pole 13. The tubular members 70 are configured to form an obtuse angle 76. The hub 19 also has a web portion 78 which serves to strengthen the hub structure and to dampen vibrations transmitted to it by the connecting poles. The opening 80 in the web of the peak hub 19 allows an attachment point for one of the peak retaining loops 60 (see FIG. 1). The hubs are thus maintained in permanent proper relation to the tent structure even when the tent is disassembled. This also speeds construction of the tent, as there is no hunting for parts and no need to match them to their proper location.

The tent 10 is thus constructed roughly according to the following sequence, although much variation in order of steps is possible. The fabric enclosure 11 and frame poles 13 are unpacked from the tent's carrying bag. The floor 36 is spread out to form the perimeter 38. The frame poles 13 are unfolded and the component pieces assembled into their final composite length by attaching them end to end, as guided by the internal elastic connectors. The upper ends 24 of the gable pole portions 16 of the frame poles 13 are attached to the ports 74 of the peak hubs 19. The frame poles 13 are then flexed slightly to allow the pins 50 of the side pin rings 48 to be inserted into the sockets 51 in the lower ends 22 of the side pole portions 14. The tension in the frame poles 13 ensures that the gable pole portion ends 24 are urged to remain in the ports 74 of the hubs 19 and the retaining pins 50 are not allowed to slip out of the sockets at the lower ends 22 of the side pole portions 14. The tension in the poles also stretches the tent fabric and ensures that the walls do not sag towards the tent's interior.

In the preferred embodiment, there are a total of four poles, i.e. the frame poles 13, which make up the entire rigid structural support of the tent 10. It will of course be obvious to one skilled in the art that the portions of the overall frame poles 13 which have been identified as the gable pole portions 16 and side pole portions 14 could be completely separate and independent gable poles and side poles. These separate side and gable poles could be connected by corner hubs, similar to the peak hubs. These corner hubs would take the place of the elbow portions 17. This however would mean that the number of poles would be doubled from 4 to 8, and would necessitate more time to sort the poles as to function. Assembly time would thus be slowed.

The frame 12, which results from the frame poles 13, peak hubs 19 and retaining pins 50, produces a very sturdy, yet light-weight structure. The frame 12 when viewed from the side is a large "V" 90 which extends from the bottom tip 92 of the V 90 to the peak hubs 19. The bottom tip 92 of this V 90 is located approximately at the center point of the side perimeter 42, and is anchored by the pin ring 48. The two side legs 94 of the V are equal in length, and tend to fall away from each other symmetrically with respect to a vertical center line 96 until stopped by the extent of the tent roof fabric. This natural tendency to spread aids in building the tent, and helps to speed the construction. A second V (not visible) is constructed in a similar manner on the opposing side of the tent 10.

The corner stakes 45 are then driven and the tent fabric 11 then cooperates with the frame 12 to create a sturdy structure which is relatively impervious to shock and buffeting by wind.

Open Roof Convertible Tent

Figure 4:
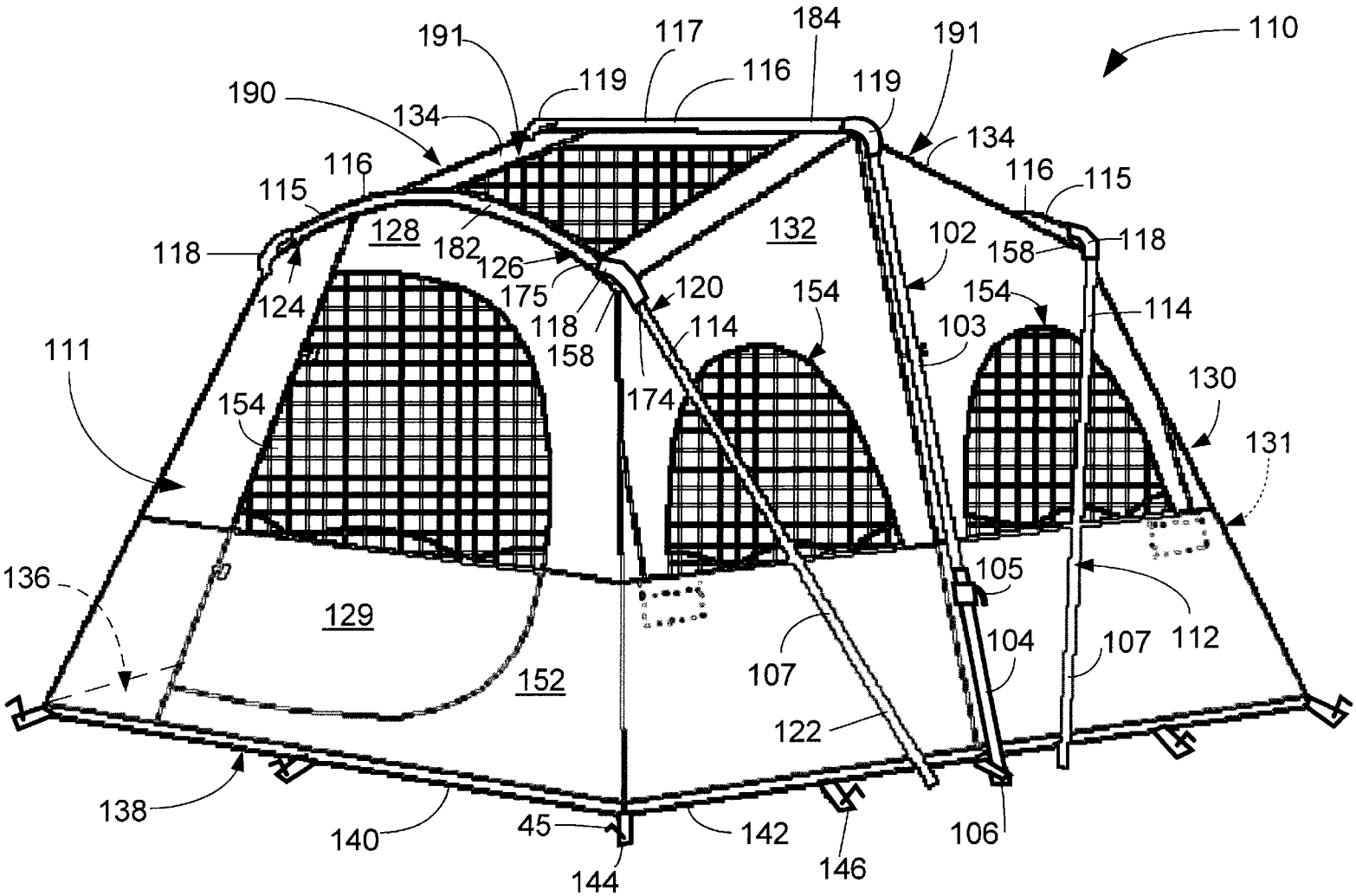
FIG. 4 illustrates a perspective view of an "Open Roof Convertible Tent" embodiment of the present invention, with the roof opened.

A second preferred embodiment of the present invention is shown in FIG. 4. Again, it is referred to generally by the reference number 110. Whenever the elements correspond to those previously enumerated, the same numbers will be used, prefixed with "1".

The tent 110 includes generally a fabric enclosure 111 and a frame 112. The frame 112 includes 6 side poles 114 and 3 gable poles, which may be more correctly termed horizontal poles 116. The side poles are of two types. First, there are two extendable center poles 102, which are each composed of an inner member 103 and an outer member 104, which has a locking mechanism 105, and a bottom foot 106. The second type of side pole 114 is the lateral pole 107, of which there are two on either of the two sides of the tent for a total of four.

The horizontal poles 116 are of two types, curvilinear poles 115 of which there are two, and a single straight ridge pole 117. The curvilinear poles 115 are made from flexible material such as fiberglass. In this preferred embodiment, the curvilinear poles 115 are hollow with interior elastic connector portions, as described above. The ridge pole 117 is of rigid material such as steel tubing which is designed not to bend. The ridge pole 117 is composed of two shorter segments 119 having curved ends, each of which is configured for mating connection with a central side pole 102 at either end. Each side pole 114 has an upper end 120 and a lower end 122. The horizontal poles 116 will be spoken of as having only first ends 124 and second ends 126.

The fabric enclosure 111 has a front wall 128 with a front door 129, a rear wall 130 with a rear door 131, two side walls 132, two roof panels 134 and a floor 136 (not visible). At the juncture of the walls 128, 130, 132 with the floor 136, there is a perimeter 138 with front and back side portions 140 and two side portions 142. At the four corners of the perimeter 138 there are corner loops 144 through which stakes 45 can be driven to secure the tent 110 to the ground. Around the perimeter 138, in the front and back portions 140 and side portion 142 there are side loops 146 which also serve to anchor the tent 110. The tent 110 also optionally has a skirt 152 and screened windows 154 which can be covered by flaps 156 (not visible) when required. The flaps 156 can be secured to block the windows 154 by peripheral zippers, ties, velcro™ fasteners or any number of other conventional means.

At the juncture of front or back walls 128, 130 and roof panels 134, there are pole sleeves 182. At the juncture of the two roof panels 134, there is a ridge pole sleeve 184. These sleeves 182, 184 serve to retain and channel the horizontal poles 116, and help to form the contours of the roof. The fabric enclosure 111 also has retaining loops 158 which are attached to the corner hubs 118 and which serve to maintain them in the proper proximity to the pole sleeves 182 and the horizontal poles 116. Four corner hubs 118 are configured to receive the upper end 120 of a side pole 114 and a first 124 or second end 126 of a curvilinear pole 115. The diameter of the side poles 114 and the curvilinear poles 115 in the preferred embodiment are different, with the curvilinear poles 115 being of a lesser diameter than the rigid side poles 114. The corner hubs 118 which receive the ends of these two poles thus necessarily have a larger diameter port 174, and a smaller diameter port 175 to receive these two different sized pole ends. The retaining loops 158 serve to keep the corner hub oriented correctly with the smaller sized port 175 facing the end 124, 126 of the curvilinear pole 115, and the larger port 174 toward the upper end 120 of the side pole 107. The retaining loop thus speeds assembly by dispensing with the step of orienting the corner hub 118 properly. It is of course possible that both poles could be made with the same diameter, in which case, the matching of the port size to the pole size is unnecessary.

Construction of the tent 110 is done by inserting the curvilinear poles 115 into the pole sleeves 182, and the ridge pole 117 into the ridge pole sleeve 184. The first ends 124 of the curvilinear poles are inserted into the smaller ports 175 of one set of the corner hubs 118. Axial force is applied to the poles 115, bending them slightly to allow them to be inserted into the second set of corner hubs 118. The retaining loops 158 that restrain the corner hubs 118 from moving then cooperate to maintain tension in the poles 115. The sleeves 182 define the allowed shape of the bow of the poles 115, and define the resulting curvilinear shape of the roof portion near the corner. The upper ends 120 of the side poles 114 are then inserted into the larger ports 174 of the corner hubs 118. Each of the curved ends of the two segments 119 of the ridge pole 117 are attached to each of the upper ends of the central side poles 102. The inner member 103 of each central side pole 102 is inserted into a hollow outer member 104, and allowed to slide within in a telescoping action. The end foot 106 of the central side pole 102 is placed on the ground and the inner pole members 103 extended to raise the roof of the tent 110 to the proper height. The retaining mechanisms 105 are then engaged, which prevent the inner members 103 from telescoping back into the outer members 104. In the preferred embodiment the inner member 103 is of larger diameter than the lateral poles 107, but it is possible that all lateral poles and the inner member poles could be the same size.

The lateral poles 107 are then brought to the proper positions and the stakes driven in the corner loops 144 and side loops to secure the lower perimeter 138. The height of the central side poles 102 may then be further extended or retracted and the angle of placement of the lateral poles 107 adjusted.

It is asserted that the particular combination of flexible poles for some areas and rigid poles for other purposes is novel and a very useful improvement on standard tent architecture.

In the preferred embodiment, roof panels 134 are fitted with fine mesh screen to form a convertible roof 190. This convertible roof 190 is especially attractive for viewing the skies from an insect-proof environment, during camping trips, and can be very useful for campers with an interest in astronomy, or for cloud watching on pleasant afternoons.

Figure 5:
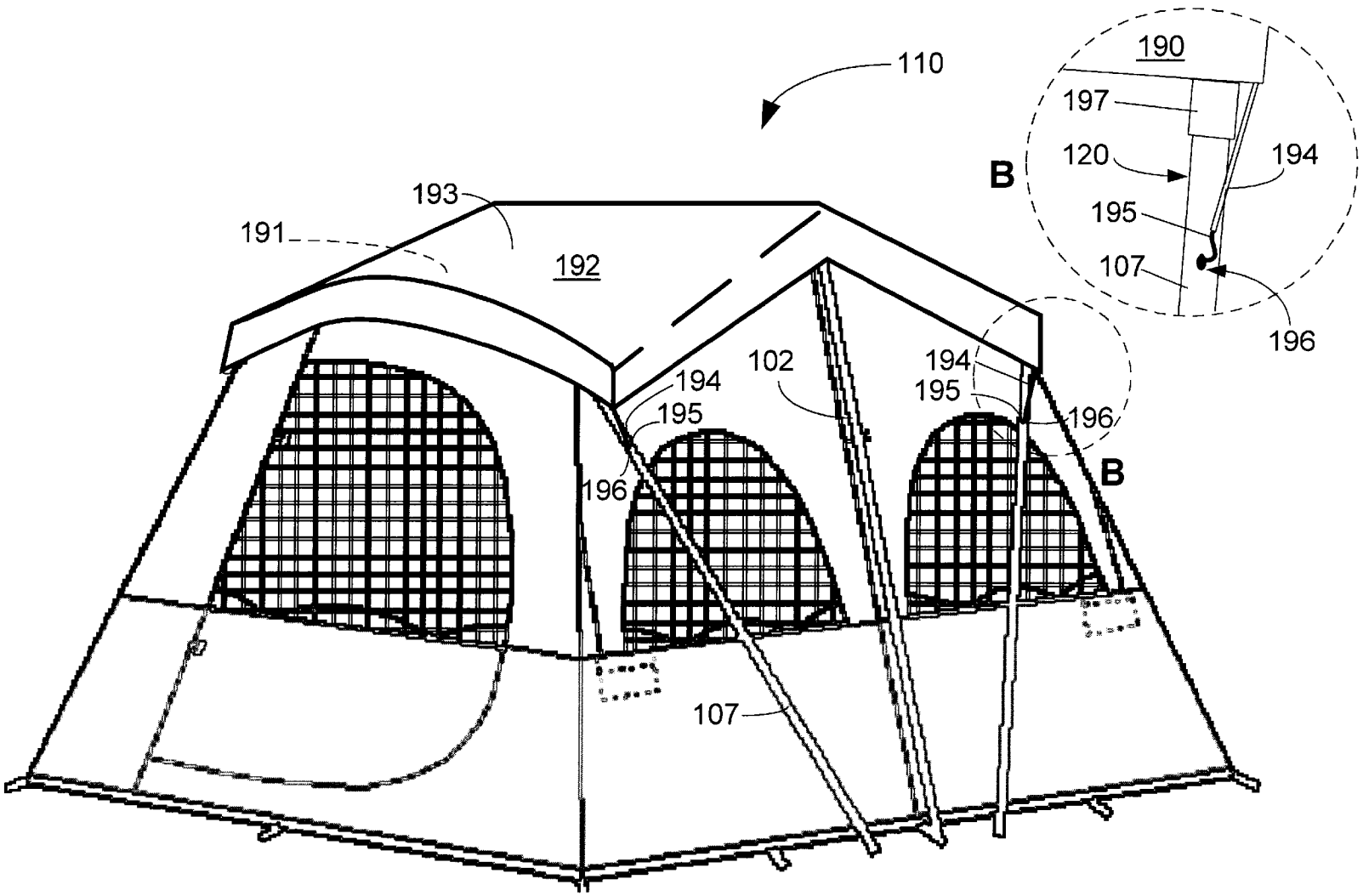
FIG. 5 shows a perspective view of an "Open Roof Convertible Tent" embodiment of the present invention, with the convertible top in place, and also including detail view B of the attachment site of a corner of the top to the support poles of the tent.

For use when rain threatens or when more protection from the wind is desired, a convertible top 192 is provided. As seen in FIG. 5, the top 192 includes a sheet 193 of waterproof material which covers the screened roof portals 191 (not visible in this view). The corners of the top 192 are fitted with elastic bands 194 which terminate in hooks 195. As seen in FIG. 5 and also in more detail in close-up view B, the hooks 195 are inserted into holes 196 in the side poles 107. The elastic bands 194 ensure that a secure seal is made between the top 192 and the tent 112, which is not easily dislodged by wind or rain. Additionally, it ensures that the sheet 193 is taut, allowing the material to conform to the curvilinear shape defined by the poles 115. This shape aids in encouraging rain to run off of the roof, avoiding puddles of accumulated water which may add weight and stress to the structure. In the preferred embodiment, the corners and side mid-points of the top 192 include loops 197 which can encircle the poles 102, 107 and close with velcro™ fasteners. These additionally anchor the top 192 to prevent it from blowing off.

Tent with Exterior Screen House

Figure 6:
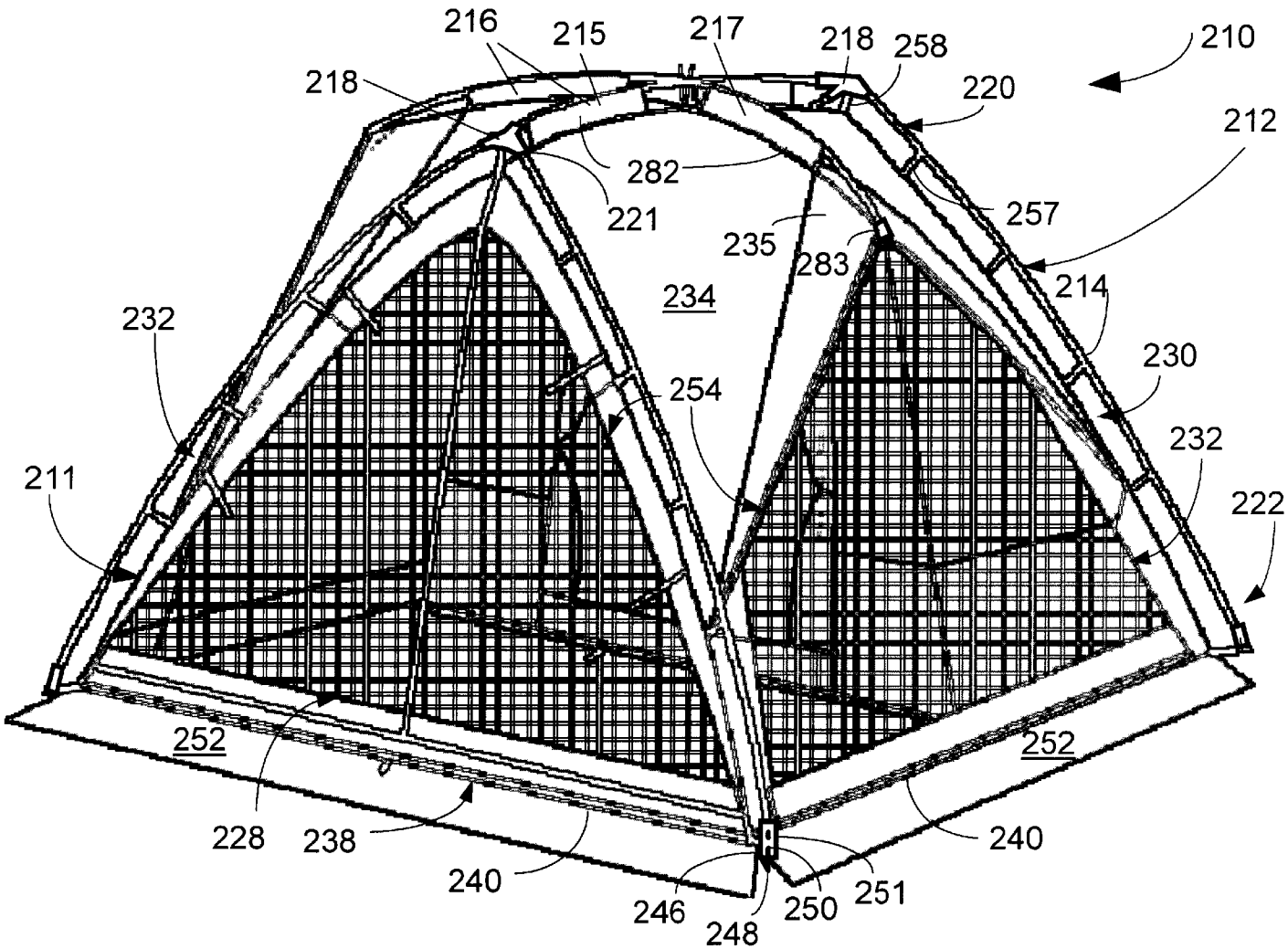
FIG. 6 illustrates a perspective view of the screen house of the "Tent with Exterior Screen House" embodiment of the present invention.
Figure 7:
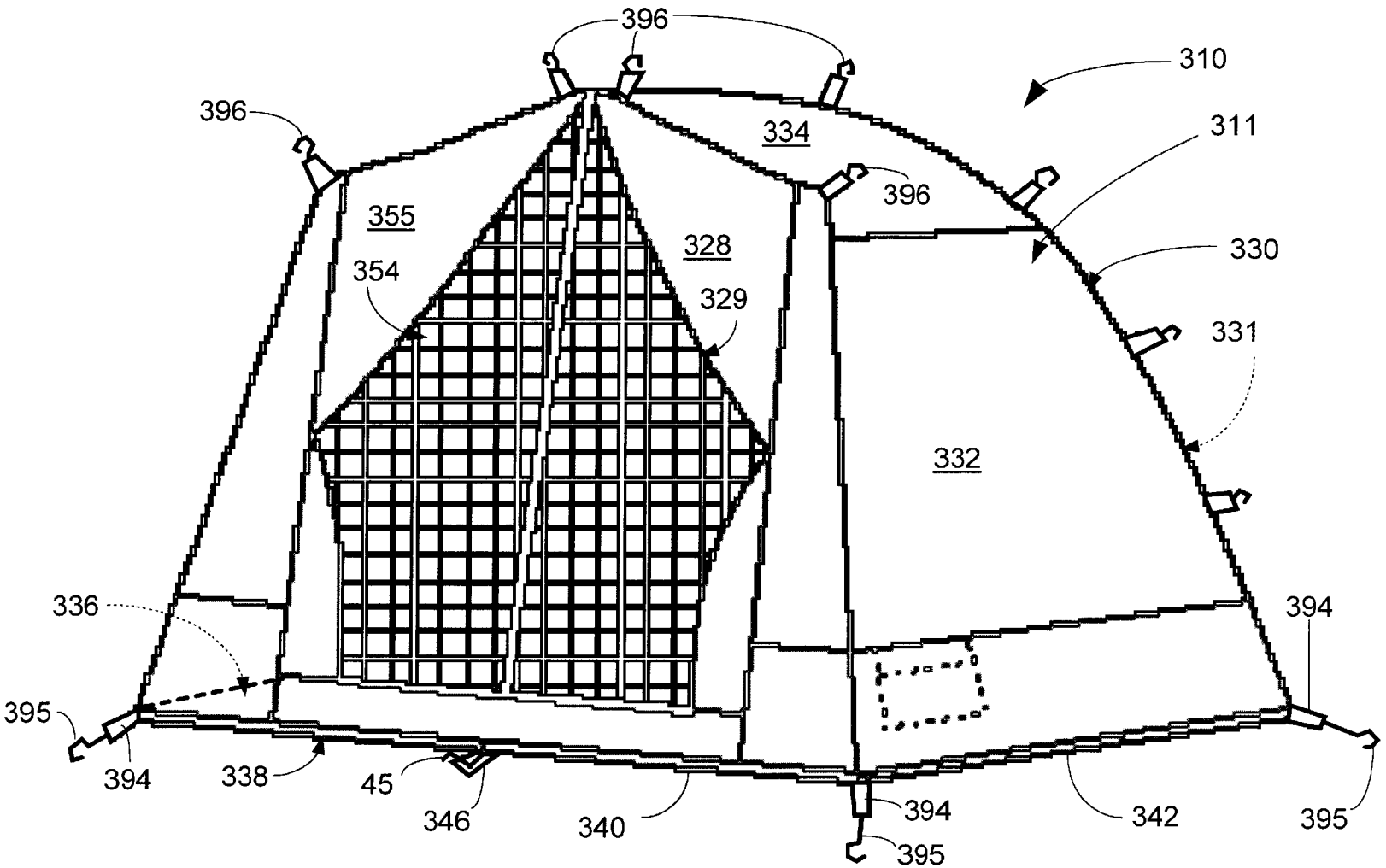
FIG. 7 shows a perspective view of the inner tent of the "Tent with Exterior Screen House" embodiment of the present invention.
Figure 8:
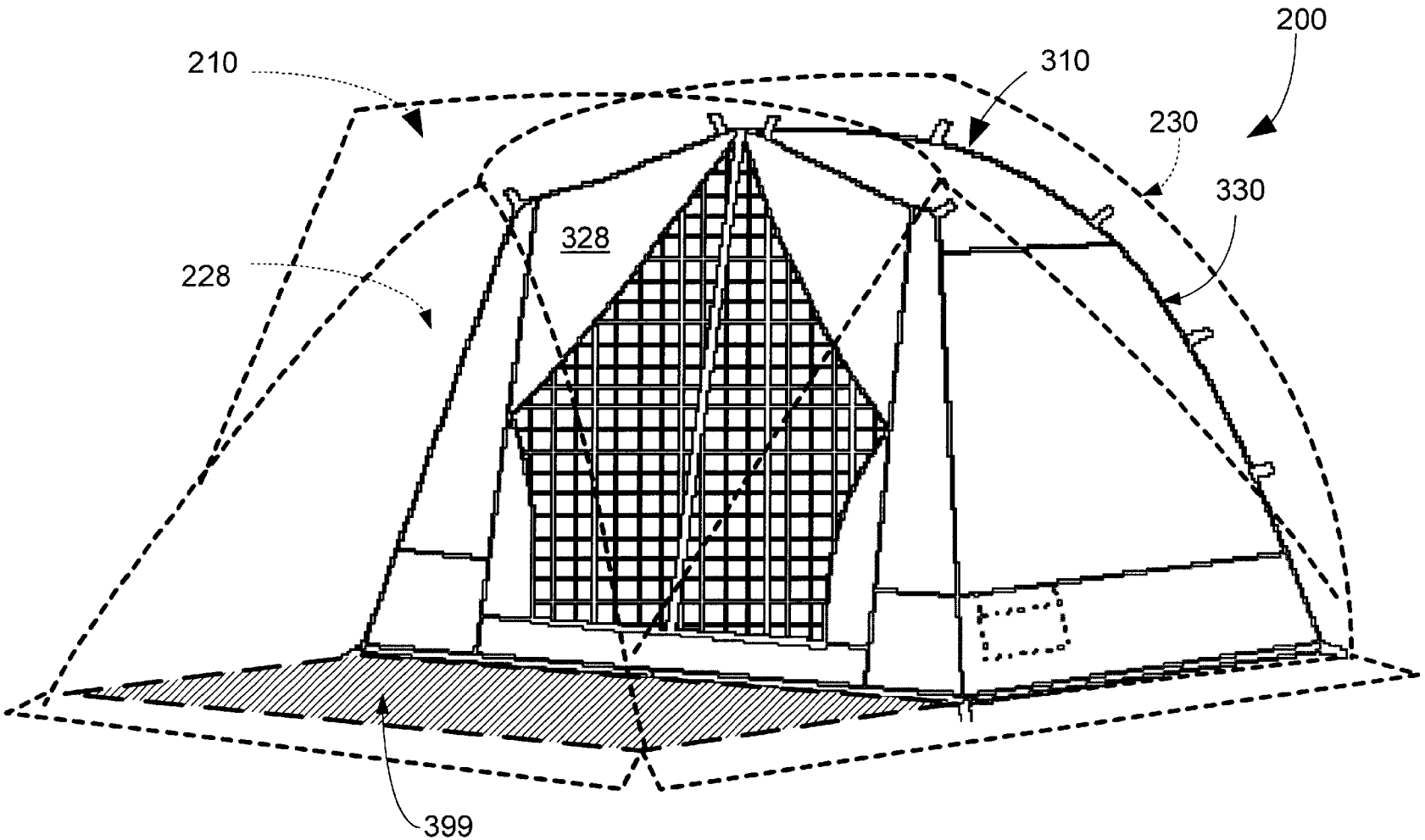
FIG. 8 illustrates a perspective view of the combined structure of the "Tent with Exterior Screen House" embodiment of the present invention with the inner tent shown in normal outline and the screen house shown in dashed outline.

A third preferred embodiment of the present invention is shown in FIGS. 6, 7 and 8. The combined structure including both an interior tent and an exterior screen house will be referred to generally by the reference number 200. Whenever referring to the elements in the screen house corresponding to those previously enumerated in reference to the elements of a tent, the same numbers will be used, prefixed by "2", and when referring to elements in the inner tent, the prefix "3" shall be used.

The outer tent, referred to as the screen house 210, includes generally a fabric enclosure 211 and a frame 212.

As shown in FIG. 6, the screen house 210 is constructed in a dome shape, with a frame 212 constructed from side poles 214 and gable poles 216 which support the fabric enclosure 211 material. The corner hubs 218 which are used to connect the poles 214, 216, are three way connectors. The screen house 210 in the preferred embodiment has a square base with a perimeter 238 having four equal sides 240 with a front wall 228 having a front door 229, a rear wall 230 having a rear door 231 and two side walls 232. There is no floor. The walls 228, 230 and 232 each have windows 254, which take up nearly the complete area of the walls. These windows 254 are fitted with screen mesh to keep insects and wildlife out, while giving a feeling of openness. The portion of the walls not taken up by the windows shall be referred to as the roof panels 234. In addition, there are cloth eaves 235 located over the side windows 254 in order to shield them from rain runoff. There is also an abbreviated skirt 252, which serves to protect the perimeter 238 from insect invasion or water seepage.

The tent has two sets of retaining sleeves 282 and a number of loops 257 which serve to channel and direct the poles 214, 216. There are loops 246 also at the four corners of the perimeter 238. These loops are each fitted with a pin ring 248 and a pin 250. These are essentially the same as the corresponding elements shown in the detail A of FIG. 1.

The side poles 214 and gable poles 216 are all made from flexible hollow tubing such as fiberglass and are composed of short segments which are attached by an internal elastic connector, as described above. The two gable poles 216 can be further classified as a longitudinal pole 215, which extends from the front wall 228 to the back wall 230, and a transverse pole 217, which extends from side wall 232 to side wall 232. The transverse pole 217 is captured at both ends by pouches 283. The transverse 217 and longitudinal 215 poles cross at roughly right angles on the roof. The side poles 214 have upper ends 220 which have a cap 221 and lower ends 222. The lower ends 222 each have a socket 251 which is sized to receive one of the pins 250 on the pin ring 248.

Figure 3:
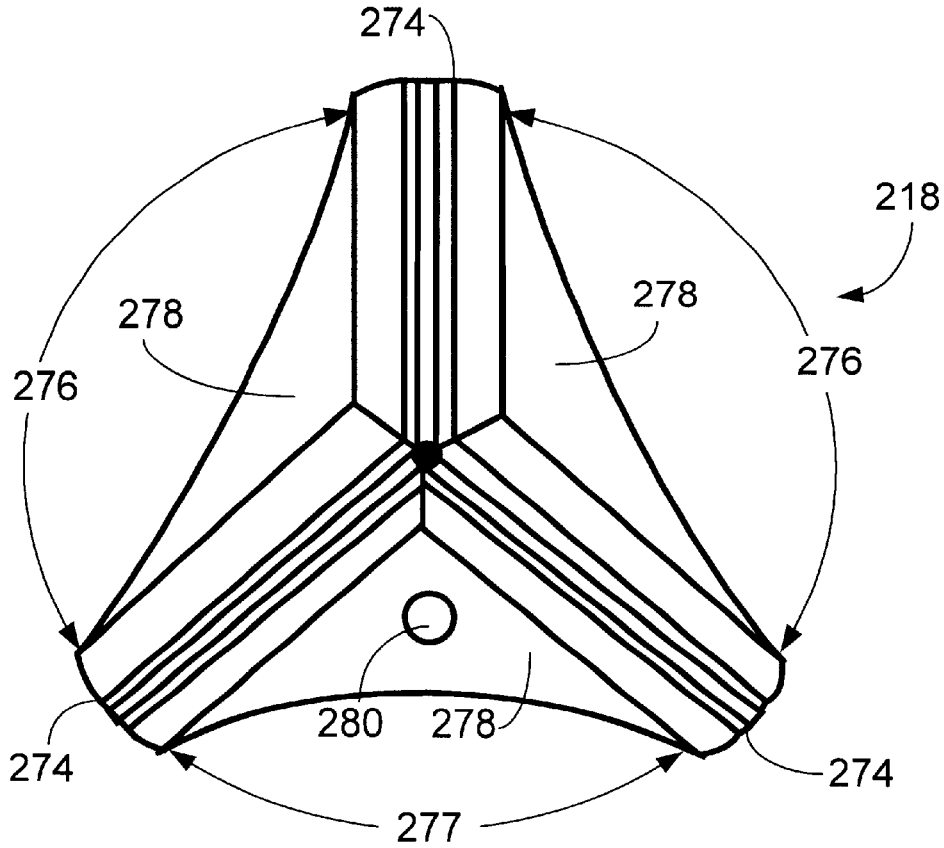
FIG. 3 shows a top plan view of a three corner hub of the present invention.

Construction of the screen house 210 is done by assembling the side poles 214 and gable poles 216 into their composite lengths. The gable poles 216 are inserted into the retaining sleeves 282. The two ends of the transverse gable pole 217 are inserted into the retaining pouches 283 after the pole is bent slightly. The retaining pouches 283 ensure that the transverse gable pole 217 is kept under tension, and that it continues to impart a curve to the upper tent portion. Referring also to FIG. 3, the longitudinal gable pole 215 is likewise inserted into its retaining sleeve 282 and both ends of this pole are inserted into the rear port 274 of the two 3-way corner hubs 218. These hubs 218 are attached to the fabric enclosure 211 by loops 258 which thread through the opening 280 in the web 278 of the hub 218. The hubs 218 are thus constrained from movement in the gable pole's 215 axial direction, and thus tension and resulting curvature are maintained in the longitudinal pole 215 as well.

As FIG. 3 shows, there are three ports 274 in the hub 218. Three web portions 278 are provided to strengthen the hub 218. There are in the preferred embodiment, two differing angles 276 and 277 between the ports. A first angle 276 is reflected bilaterally and measures approximately 130 degrees in the preferred embodiment between the ports that receive the longitudinal gable pole 215 and one of the side poles 214 (FIG. 6). The second angle 277 measures approximately 100 degrees between the ports for receiving two side poles 214 (FIG. 6). It will be apparent to one skilled in the art that these angles are subject to much variation; for example, it is possible that both angles 276 and 277 may be equal, in which case all angles would be 120 degrees. As mentioned above, an opening 280 is provided for insertion of a loop 258 to attach the hub 218 to the screen house 210 in a fixed orientation (FIG. 6).

Referring again to FIGS. 3 and 6, the side poles 214 are inserted through the tent loops 257 and their upper ends 220 inserted into the ports 274 of the hubs 218. Axial pressure is applied to the poles 214, causing them to bow, and the pins 250 are inserted into the sockets 251 to constrain the poles 214 from axial movement. The screen house 210 is thus constructed, and the pressure in the captured poles urges the fabric enclosure 211 to form a dome shape. The interior of the screen house 210 has a number of interior loops 259 (not visible) attached on the ceiling and interior perimeter, which act as attachment points for the inner tent, to be described below.

The inner tent preferred embodiment 310 is illustrated in FIG. 7 and 8. The fabric enclosure 311 includes a front door wall 328, a rear door wall 330 and two side walls 332, as well as roof portion 334 and floor 336 (not visible in this figure). The front door wall 328 and rear door wall 330 have screened window portions 354 as well as covering flaps 355 which can be fastened to block wind from flowing through the windows 354. When not in use, the flaps 355 can be tied back out of the way. The juncture of the floor 336 and walls 328, 330, 332 define a perimeter 338 having front and back portions 340 and side portions 342. At the corners of the perimeter 338 there are elastic bands 394 with hooks 395. Also at the juncture of the front wall 328, the rear wall 330 and the roof portions 334 there are a series of hooks 396 which attach to interior loops 259 (not visible) of the screen house 210. The hooks 395 of the elastic bands 394 also attach to interior loops 259, and the inner tent 310 is thus suspended within the screen house 210. Side loops 346 are secured to the ground by stakes 45, which are also used to anchor some of the lower interior loops 259 to the ground. The rear hooks 395 with elastic bands 394 can be secured by attachment to the pin rings 248 of the screen house 210, and thus the entire perimeter 338 of the floor 336 is secured.

The inner tent 310 is especially unique in requiring no pole structure of its own. In fact, the entire double dome structure 200 is supported by a total of only 6 light-weight poles. This provides a great advantage in reduction of weight and number of parts.

A composite view of the relationship between the inner tent 310 and the screen house 210 is illustrated in FIG. 8. A rough outline of the screen house 210 is shown in dashed line. The inner tent 310 is preferably oriented so that the entire tent is offset toward the rear door wall 230 of the screen house 210. The rear wall 330 of the inner tent 312 abuts the rear wall 230 of the screen house 210. The inner tent 310 has a rectangular floor area within the larger square base of the screen house 210. This leaves a free space between the front wall 328 of the inner tent 310 and the front wall 228 of the screen house 210, and this space also has a rectangular aspect. This area within the screen house 210, but exterior to the inner tent 310 shall be referred to as the porch area 399. The porch area 399 has no floor but is securely screened from the environment by large mesh screen in all the windows 254. This porch area 399 has many uses, such as an area for cleaning boots, or other activities that would be messy if conducted in the inner tent or other conventional tent that is completely enclosed. In a conventional tent any debris must be swept out or carried along with the tent when it is moved, but the porch area 399 of the screen house 210 allows debris to remain in the environment after the tent is removed. The porch area 399 can also provide a place for securely storing spiked boots, or other equipment which might otherwise threaten to puncture a tent floor but which may too valuable to leave completely unguarded. Additionally, lawn furniture can be thus be erected in this porch area 399 which has an agreeable feeling of openness, while still protecting the inhabitants from insect intrusions. The screen house 210 can, of course be used by itself without assembling the inner tent 310 to serve as a kind of portable gazebo.

The inner tent 310 preferably has fine mesh screening which can protect the inhabitants against very small flying pests known as "no-see-ums". The screen house 210 adds an additional layer of protection with its screens for added security.

In addition to the above mentioned examples, various other modifications and alterations of the inventive improved camping tents 10 may be made without departing from the invention. Accordingly, the above disclosure is not to be considered as limiting and the appended claims are to be interpreted as encompassing the true spirit and the entire scope of the invention.

INDUSTRIAL APPLICABILITY

The present improved camping tents 10, 110, 200 are well suited for application in outdoor camping. Each one has specific features that make it particularly well adapted for its purposes.

The Quick Pitch Tent 10 has a frame structure 12 which has includes four frame poles 13 which are grouped into two pairs, each pair being configured to be in a V-shape 90. The legs of the V tend to fall away from each other so that they naturally spread apart and enlarge the space enclosed by the fabric enclosure 11. This natural spreading tendency enables the user to very quickly assemble the tent, which can be of great benefit in bad weather, or where insects make the need to enter a completed tent urgent. Other features included such as the pin rings 48, the elastic connectors inside component pieces of the frame poles 13, and the peak hubs 19 all enhance the speed with which the tent 10 can be erected. Campers who have hiked long distances or engaged in other strenuous activities before being faced with the task of pitching a tent, will especially appreciate the ease and convenience of this tent, and the minimal number of pieces with which it is constructed.

The Open Roof Convertible Tent 110 is especially useful for those campers who appreciate a more open feeling to their tent. Students of astronomy or cloud watchers will appreciate the chance to observe the skies without the annoyance of insects. The convertible top 192 is preferably water-proof, and can be easily installed by covering the screened roof panels 134, and then attaching the corners by elastic bands 194 which terminate in hooks 195. The hooks 195 can preferably attach to holes 196 in the side poles 107. The top 192 is then securely anchored, so that wind-driven rain is excluded from the tent.

The Tent with Exterior Screen House 200 provides an outer screen house 210 which surrounds a smaller inner tent 310. The screen house 210 has a fabric enclosure 211 and a frame 212. The inner tent 310 has its own fabric enclosure 311, but in order to use the smallest number of parts, the screen house frame 212 supports both the screen house fabric enclosure 211 and the inner tent fabric enclosure 311. The area within the screen house 210 but outside of the inner tent 310 provides a porch area 399, which can be used for storing articles which may be too dirty to bring into the inner tent 310 area, such as muddy boots, etc. Also articles such as spiked boots which would tend to puncture the floor 336 of the inner tent 310 can be stored in the porch area 399. It is also possible to erect lawn chairs in the porch area 399, and to use it as a sitting room which has an agreeable feeling of openness, without exposing the users to insect attacks.

For the above, and other, reasons, it is expected that the improved camping tents 10, 110, 200 of the present invention will have widespread industrial applicability. Therefore, it is expected that the commercial utility of the present invention will be extensive and long lasting.

What is claimed is:

1. A tent with exterior screen structure comprising:

an inner tent structure, including an inner fabric enclosure having walls, a roof and a floor, which serve as walls, roof and floor of said inner tent structure;

an outer tent structure including an outer fabric enclosure which encloses said inner tent structure and a frame which supports said inner and outer fabric enclosures.

2. A tent with exterior screen structure as in claim 1, wherein:

said inner tent structure includes a plurality of hooks which attach said inner tent structure to said outer tent structure.

3. A tent with exterior screen structure as in claim 1, wherein:

said inner tent structure is suspended within said outer tent structure.

4. A tent with exterior screen structure as in claim 1, wherein:

said outer tent structure is larger in volume than said inner tent structure so that said outer tent structure also encloses a porch area which is within said outer tent structure, but outside of said inner tent structure.

5. A tent with exterior screen structure as in claim 1, wherein:

said outer tent structure is a dome tent.

6. A tent with an exterior screen structure as in claim 1, wherein:

said fabric enclosure includes sleeves which channel portions of said frame.

7. A tent with an exterior screen structure as in claim 1, wherein:

said frame includes side poles and gable poles.

8. A tent with an exterior screen structure as in claim 7, wherein:

said side poles and gable poles are connected by corner hubs.

9. A tent with an exterior screen structure as in claim 8, wherein:

said corner hubs are attached in position to portions of said fabric enclosure thereby aiding in the quick construction of said tent.

10. A tent with an exterior screen structure as in claim 7, wherein:

said side poles include a plurality of component pieces, each component piece having a central bore; and elastic connectors are positioned within said central bore and said elastic connectors connect said side poles component pieces to quickly form said side poles.

11. A tent with an exterior screen structure as in claim 1, wherein:

said frame includes frame poles having a hollow portion near said lower end of said frame pole;

said floor of said fabric enclosure has a perimeter; and at least one pin ring including at least one pin is attached to said perimeter of said fabric enclosure, such that said pin can be inserted into said hollow portion of said frame pole in order to quickly secure the position of said frame pole lower end and aid in the quick construction of said tent.

12. A tent with an exterior screen structure as in claim 11, wherein:

said hollow portion of said frame poles is a socket.

13. A tent with an exterior screen structure as in claim 1, wherein:

said floor of said fabric enclosure has a perimeter; and said perimeter includes attachment points for stakes.

* * * * *